US010710368B2

(12) United States Patent
Kiuchi et al.

(10) Patent No.: US 10,710,368 B2
(45) Date of Patent: Jul. 14, 2020

(54) INKJET PRINTING APPARATUS

(71) Applicant: CANON KABUSHIKI KAISHA, Tokyo (JP)

(72) Inventors: Takahiro Kiuchi, Fuchu (JP); Noriko Sato, Kawasaki (JP); Hiroshi Nakai, Sagamihara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 15/955,005

(22) Filed: Apr. 17, 2018

(65) Prior Publication Data

US 2018/0311961 A1 Nov. 1, 2018

(30) Foreign Application Priority Data

May 1, 2017 (JP) ..... 2017-091337

(51) Int. Cl.
*B41J 2/155* (2006.01)
*B41J 2/21* (2006.01)
*B41J 2/165* (2006.01)

(52) U.S. Cl.
CPC ..... *B41J 2/155* (2013.01); *B41J 2/16508* (2013.01); *B41J 2/16535* (2013.01); *B41J 2/16538* (2013.01); *B41J 2/16588* (2013.01); *B41J 2/2146* (2013.01)

(58) Field of Classification Search
CPC ..... B41J 2/155; B41J 2/2146; B41J 2/16535; B41J 2/16538
See application file for complete search history.

(56) References Cited

U.S. PATENT DOCUMENTS 6,582,048 B1 * 6/2003 Akahira ..... B41J 2/04505 347/106
2009/0184998 A1 * 7/2009 Tamaki ..... B41J 2/16585 347/33
2014/0374375 A1 * 12/2014 Zwiers ..... G01N 21/95607 216/13

FOREIGN PATENT DOCUMENTS

JP 2009-235589 A 10/2009

OTHER PUBLICATIONS

Copending, unpublished, U.S. Appl. No. 15/955,813 to Hiroshi Nakai et al., filed Apr. 18, 2018.

* cited by examiner

*Primary Examiner* — Julian D Huffman
(74) *Attorney, Agent, or Firm* — Venable LLP

(57) ABSTRACT

There is provided an inkjet printing apparatus including: a print head having an ejection opening surface on which a plurality of ejection units each provided with an ejection opening for ejecting ink are arrayed in a first direction; a wiping member configured to wipe the ejection opening surface; and a moving unit configured to move the wiping member in a second direction crossing the first direction, wherein a longitudinal direction of the wiping member is inclined with respect to an edge of the print head located downstream in the second direction and is substantially in parallel with a direction defined by an edge of the ejection unit.

11 Claims, 15 Drawing Sheets

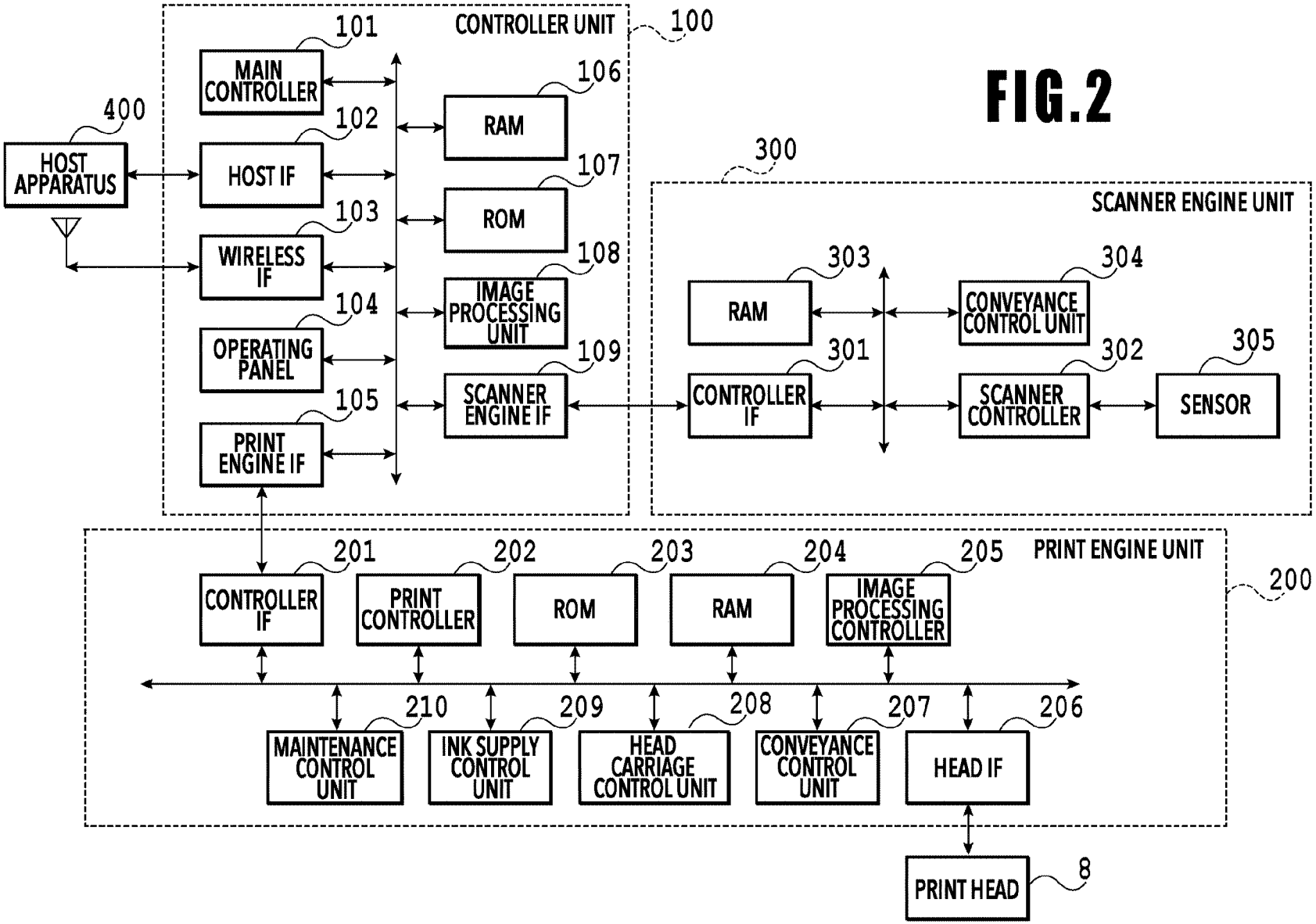
FIG.2
SCANNER ENGINE UNIT
300
305
SENSOR
304
CONVEYANCE CONTROL UNIT
302
SCANNER CONTROLLER
303
RAM
301
CONTROLLER IF
200
PRINT ENGINE UNIT
205
IMAGE PROCESSING CONTROLLER
206
HEAD IF
8
PRINT HEAD
204
RAM
207
CONVEYANCE CONTROL UNIT
203
ROM
208
HEAD CARRIAGE CONTROL UNIT
202
PRINT CONTROLLER
209
INK SUPPLY CONTROL UNIT
201
CONTROLLER IF
210
MAINTENANCE CONTROL UNIT
100
CONTROLLER UNIT
106
RAM
107
ROM
108
IMAGE PROCESSING UNIT
109
SCANNER ENGINE IF
101
MAIN CONTROLLER
102
HOST IF
103
WIRELESS IF
104
OPERATING PANEL
105
PRINT ENGINE IF
400
HOST APPARATUS

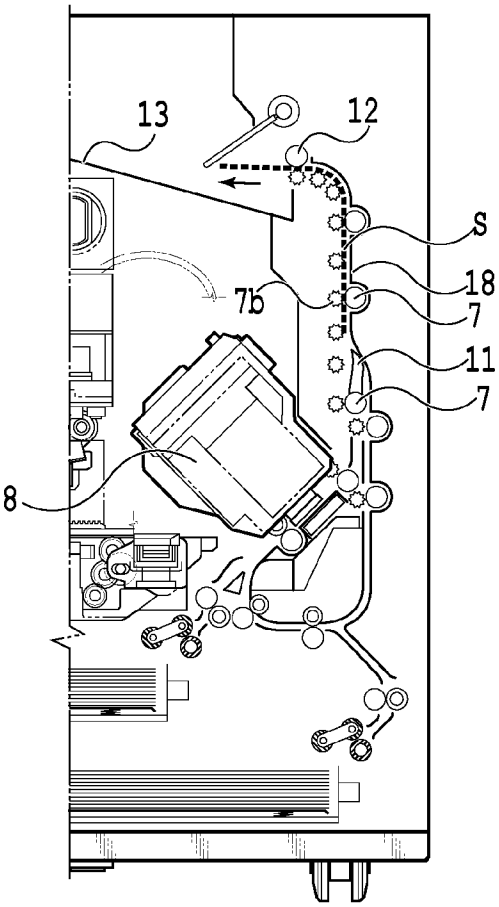
FIG.4C
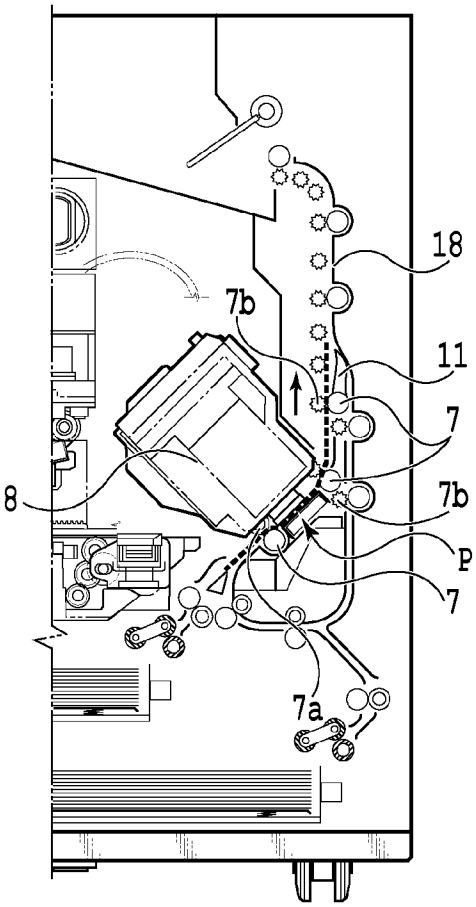
FIG.4B
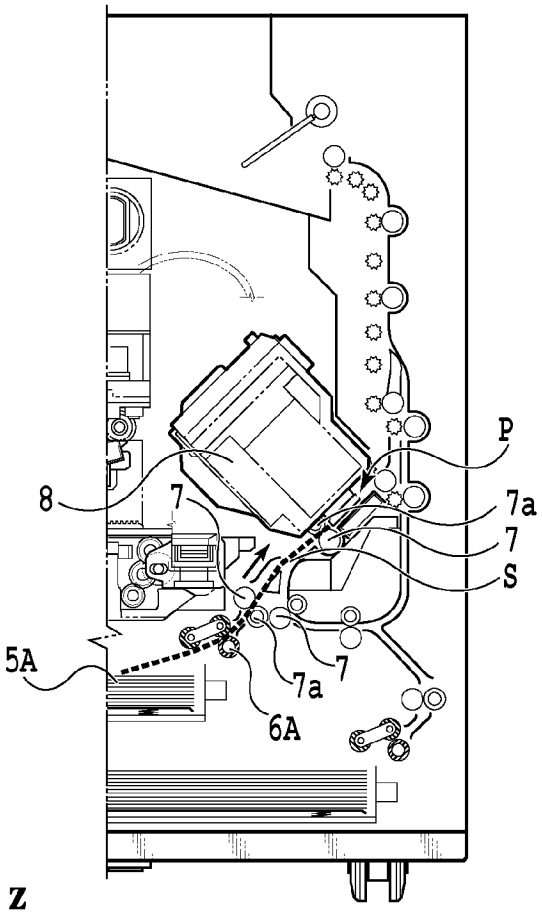
FIG.4A
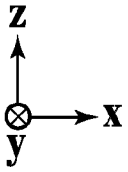

INKJET PRINTING APPARATUS

BACKGROUND OF THE INVENTION

Field of the Invention

The present invention relates to an inkjet printing apparatus.

Description of the Related Art

There is a technique of cleaning an ejection opening surface of a head unit mounted on an inkjet printing apparatus. Japanese Patent Laid-Open No. 2009-235589 (hereinafter referred to as PTL 1) discloses a cleaning unit having a plurality of wiping members arrayed in a longitudinal direction of a line head, and also a technique of cleaning the ejection opening surface having ink adhering thereto in the line head by moving the cleaning unit in a lateral direction of the line head. Further, PTL 1 discloses an example of a line head composed of a plurality of head units.

In PTL 1, the longitudinal direction of the wiping members is in parallel with the longitudinal direction of the line head. That is, the width direction in which one wiping member can wipe ink off is in parallel with the longitudinal direction of the line head. In this case, the warped wiping member, which has wiped the ink off on the ejection opening surface, instantly returns to its original state in the case of passing by an edge of the line head. This may cause spattering of the ink having adhered to the wiping member. In addition, in the case where a line head has a plurality of head units like in PTL 1, wiping members may have scratches if the wiping member comes into contact with a corner portion of the head unit. This may result in lower durability of the wiping members.

SUMMARY OF THE INVENTION

According to an aspect of the present invention, there is provided an inkjet printing apparatus including: a print head having an ejection opening surface on which a plurality of ejection units each provided with an ejection opening for ejecting ink are arrayed in a first direction; a wiping member configured to wipe the ejection opening surface; and a moving unit configured to move the wiping member in a second direction crossing the first direction, wherein a longitudinal direction of the wiping member is inclined with respect to an edge of the print head located downstream in the second direction and is substantially in parallel with a direction defined by an edge of the ejection unit.

Further features of the present invention will become apparent from the following description of exemplary embodiments with reference to the attached drawings.

BRIEF DESCRIPTION OF THE DRAWINGS

FIG. 2 is a control configuration diagram of the printing apparatus;

FIGS. 4A to 4C are conveying path diagrams of a print medium fed from a first cassette;

DESCRIPTION OF THE EMBODIMENTS

Figure 1:
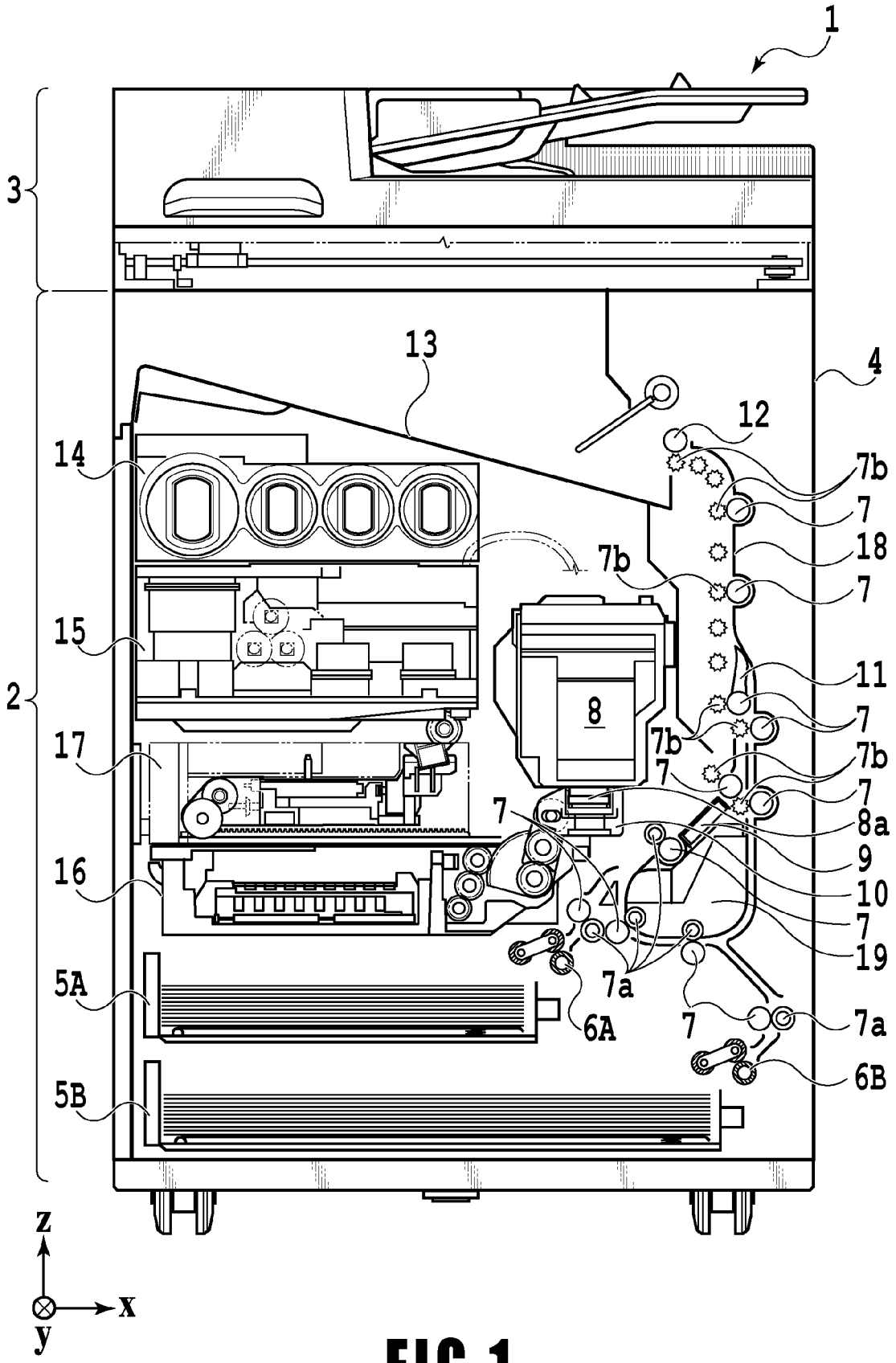
FIG. 1 is a diagram showing a printing apparatus in a standby state.

Embodiments of the present invention will be described with reference to the drawings. It should be noted that the following embodiments do not limit the present invention and that not all of the combinations of the characteristics described in the present embodiments are essential for solving the problem to be solved by the present invention. Incidentally, the same reference numeral refers to the same component in the following description. Furthermore, relative positions, shapes, and the like of the constituent elements described in the embodiments are exemplary only and are not intended to limit the scope of the invention.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing a print medium (cut sheet) S are detachably provided at the bottom of a casing 4 in the vertical direction. A relatively small print medium of up to A4 size is placed flat and housed in the first cassette 5A and a relatively large print medium of up to A3 size is placed flat and housed in the second cassette 5B. A first feeding unit 6A for sequentially feeding a housed print medium is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 and driven by a conveying motor (not shown). The pinch rollers 7*a* are follower rollers that are turned while nipping a print medium S together with the conveying rollers 7. The discharging roller 12 is a drive roller located downstream of the conveying rollers 7 and driven by the conveying motor (not shown). The spurs 7*b* nip and convey a print medium S together with the conveying rollers 7 and discharging roller 12 located downstream of the print head 8.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for placing and housing a print medium S that was subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports, from the back side, a print medium S subjected to print operation by the print head 8. The movement of the print head 8 from the standby position to a printing position will be described later in detail.

An ink tank unit 14 separately stores ink of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 conveys a print medium S by driving the feeding units 6A and 6B, conveying rollers 7, discharging roller 12, and flapper 11 shown in FIG. 1 via a conveyance control unit 207. The print head 8 performs print operation in synchronization with the conveyance operation of the print medium S under instructions from the print controller 202, thereby performing printing.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
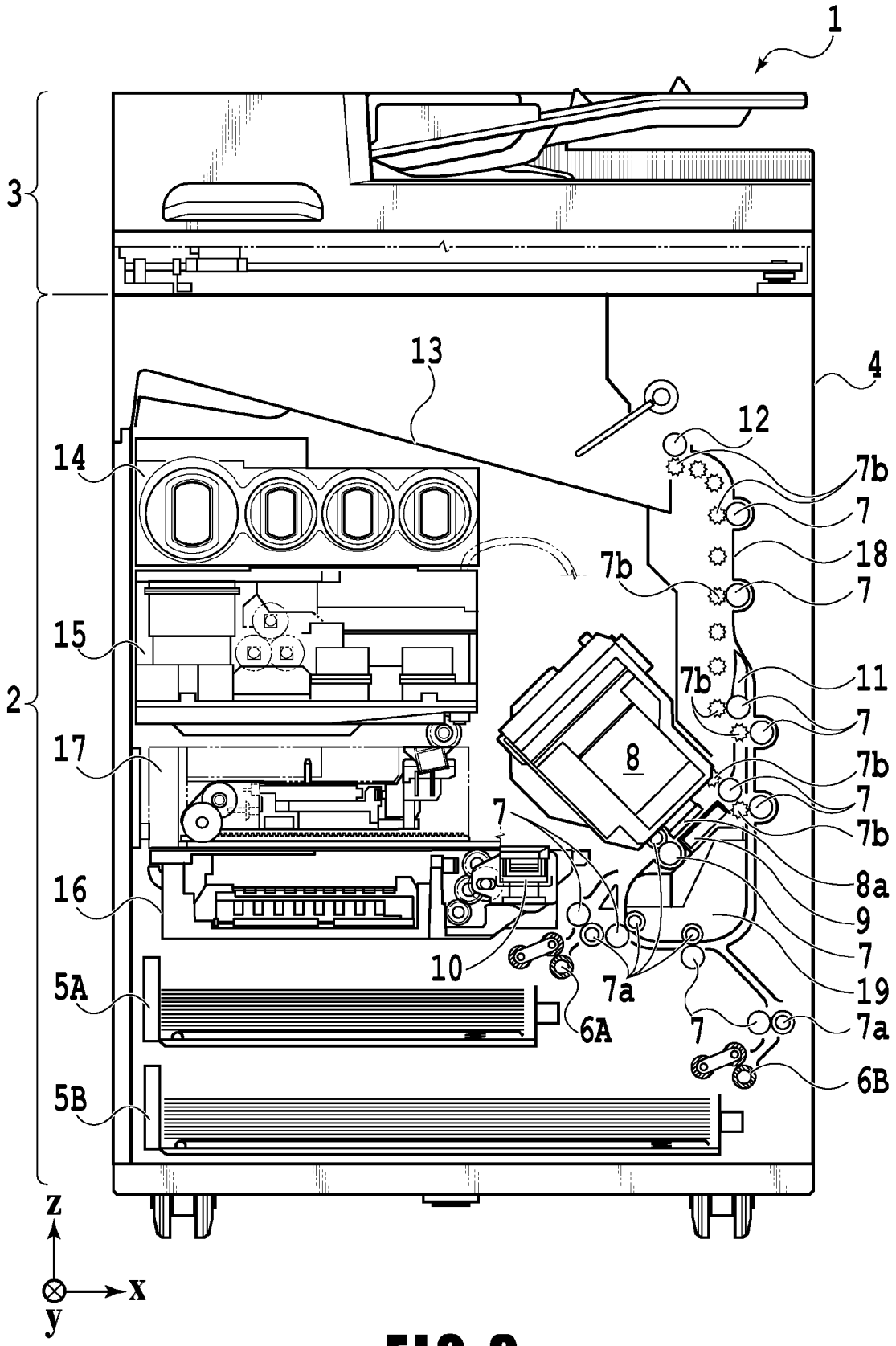
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating the cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

FIGS. 4A to 4C are diagrams showing a conveying path in the case of feeding an A4 size print medium S from the first cassette 5A. A print medium S at the top of a print medium stack in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
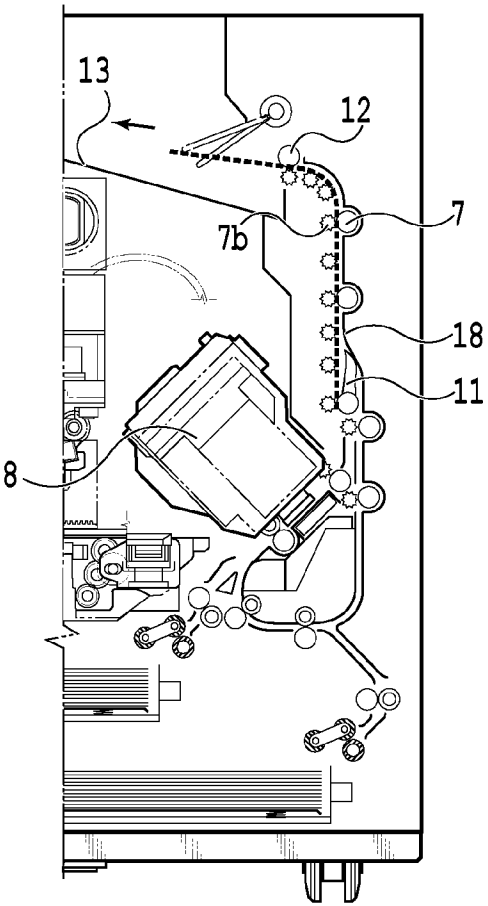
FIGS. 5A to 5C are conveying path diagrams of a print medium fed from a second cassette.
Figure 5B:
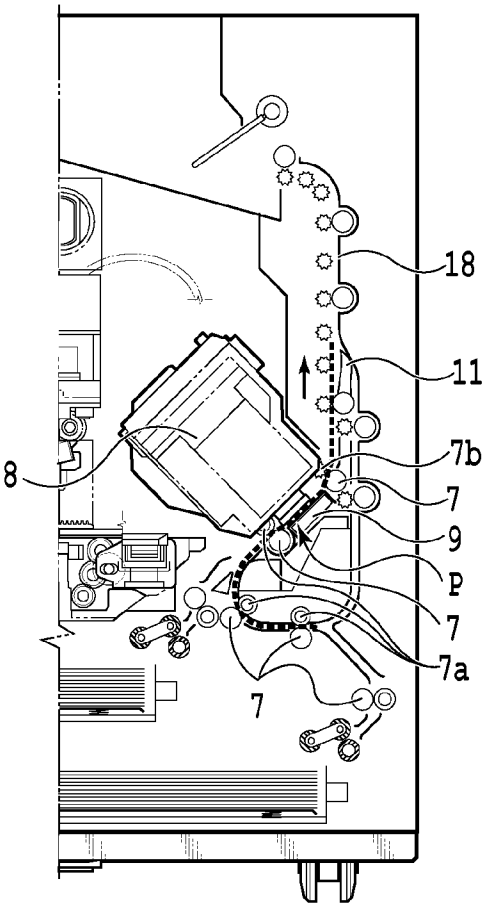
Figure 5A:
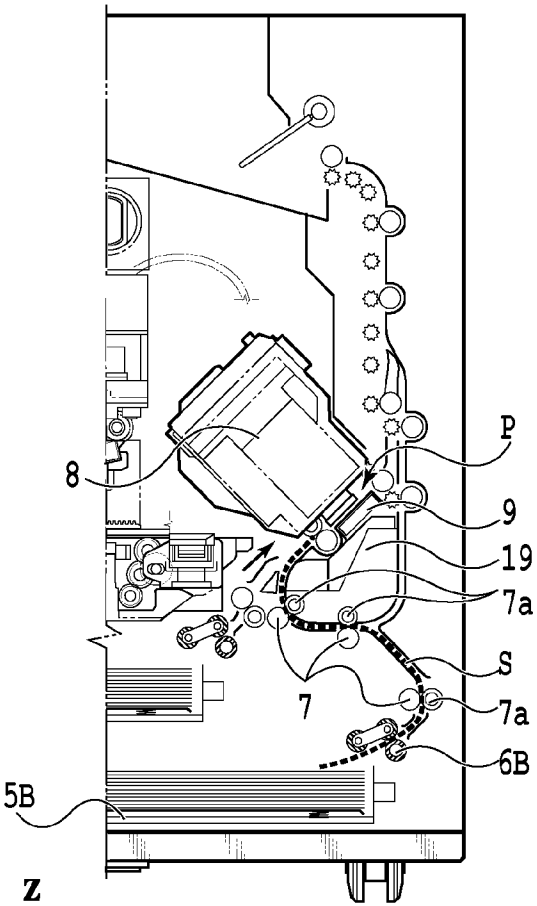

FIGS. 5A to 5C are diagrams showing a conveying path in the case of feeding an A3 size print medium S from the second cassette 5B. A print medium S at the top of a print medium stack in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
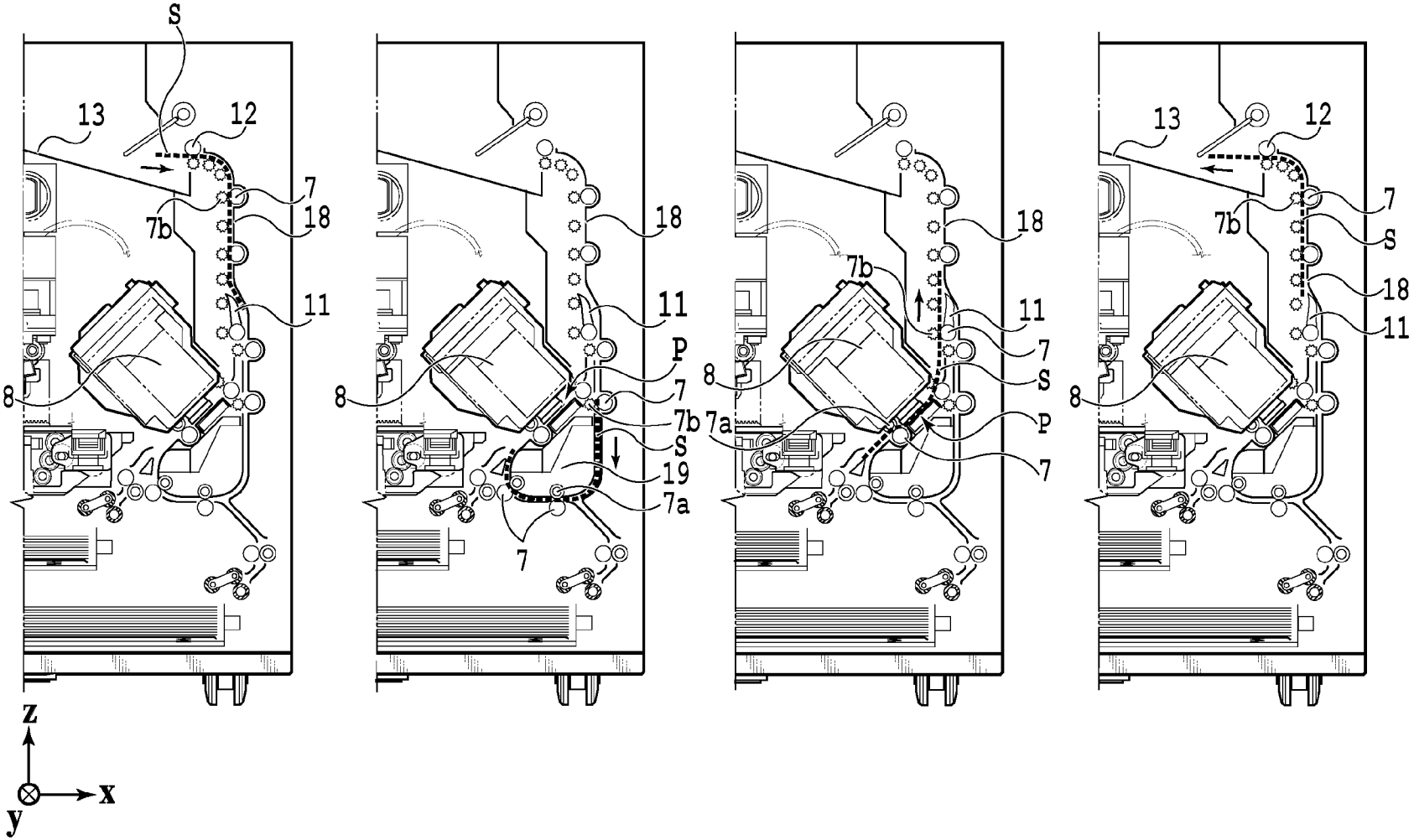
FIGS. 6A to 6D are conveying path diagrams in the case of performing print operation for the back side of a print medium.

After the print head 8 finishes print operation for the first side and the back end of the print medium S passes by the flapper 11, the print controller 202 turns the conveying rollers 7 reversely to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
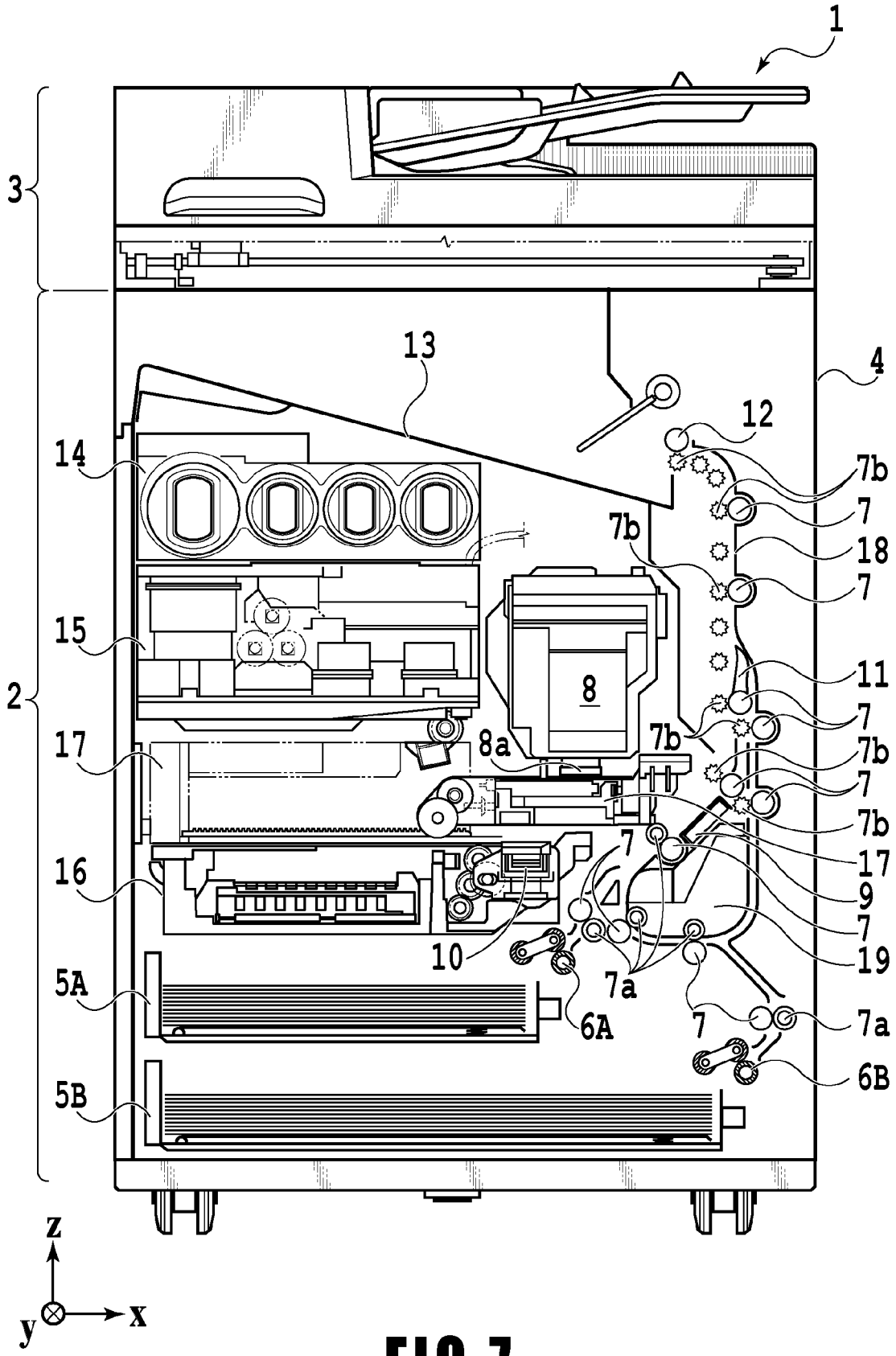
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed by the maintenance unit 16.

Figure 8A:
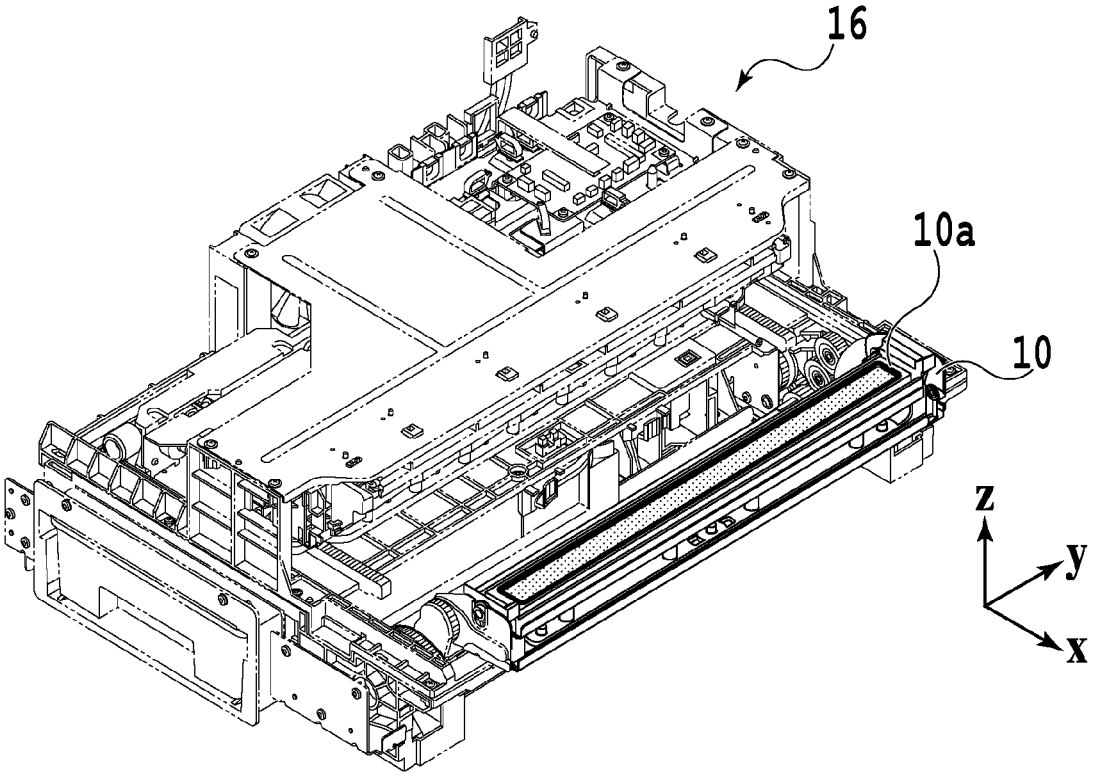
FIGS. 8A and 8B are perspective views showing the configuration of a maintenance unit.
Figure 8B:
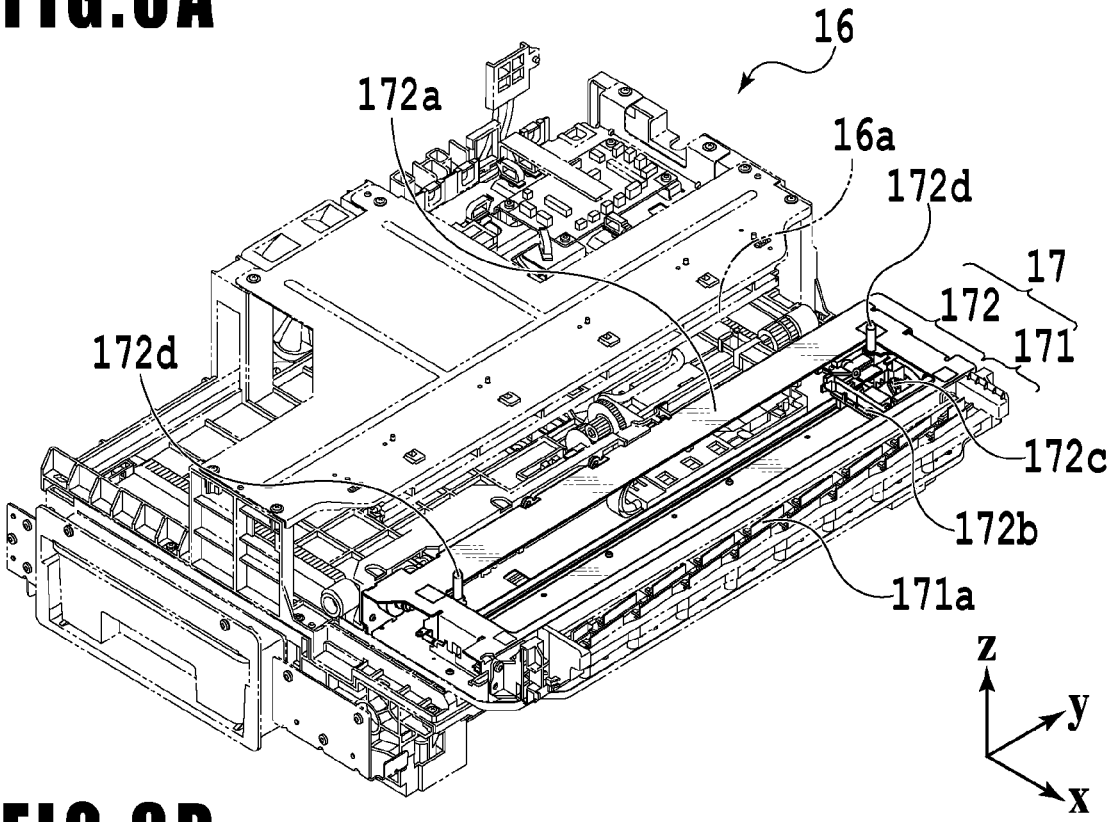

FIG. 8A is a perspective view showing the maintenance unit 16 in a standby position. FIG. 8B is a perspective view showing the maintenance unit 16 in a maintenance position. FIG. 8A corresponds to FIG. 1 and FIG. 8B corresponds to FIG. 7. When the print head 8 is in the standby position, the maintenance unit 16 is in the standby position shown in FIG. 8A, the cap unit 10 has been moved vertically upward, and the wiping unit 17 is housed in the maintenance unit 16. The cap unit 10 comprises a box-shaped cap member 10*a* extending in the y-direction. The cap member 10*a* can be brought into intimate contact with the ejection opening surface 8*a* of the print head 8 to prevent ink from evaporating from the ejection openings. The cap unit 10 also has the function of collecting ink ejected to the cap member 10*a* for preliminary ejection or the like and allowing a suction pump (not shown) to suck the collected ink.

On the other hand, in the maintenance position shown in FIG. 8B, the cap unit 10 has been moved vertically downward and the wiping unit 17 has been drawn from the maintenance unit 16. The wiping unit 17 comprises two wiper units: a blade wiper unit 171 and a vacuum wiper unit 172.

In the blade wiper unit 171, blade wipers 171*a* for wiping the ejection opening surface 8*a* in the x-direction are provided in the y-direction by the length of an area where the ejection openings are arrayed. In the case of performing wiping operation by the use of the blade wiper unit 171, the wiping unit 17 moves the blade wiper unit 171 in the x-direction while the print head 8 is positioned at a height at which the print head 8 can be in contact with the blade wipers 171*a*. This movement enables the blade wipers 171*a* to wipe ink and the like adhering to the ejection opening surface 8*a*.

The entrance of the maintenance unit 16 through which the blade wipers 171*a* are housed is equipped with a wet wiper cleaner 16*a* for removing ink adhering to the blade wipers 171*a* and applying a wetting liquid to the blade wipers 171*a*. The wet wiper cleaner 16*a* removes substances adhering to the blade wipers 171*a* and applies the wetting liquid to the blade wipers 171*a* each time the blade wipers 171*a* are inserted into the maintenance unit 16. The wetting liquid is transferred to the ejection opening surface 8*a* in the next wiping operation for the ejection opening surface 8*a*, thereby facilitating sliding between the ejection opening surface 8*a* and the blade wipers 171*a*.

The vacuum wiper unit 172 comprises a flat plate 172*a* having an opening extending in the y-direction, a carriage 172*b* movable in the y-direction within the opening, and a vacuum wiper 172*c* mounted on the carriage 172*b*. The vacuum wiper 172*c* is provided to wipe the ejection opening surface 8*a* in the y-direction along with the movement of the carriage 172*b*. The tip of the vacuum wiper 172*c* has a suction opening connected to the suction pump (not shown). Accordingly, if the carriage 172*b* is moved in the y-direction while operating the suction pump, ink and the like adhering to the ejection opening surface 8*a* of the print head 8 are wiped and gathered by the vacuum wiper 172*c* and sucked into the suction opening. At this time, the flat plate 172*a* and a dowel pin 172*d* provided at both ends of the opening are used to align the ejection opening surface 8*a* with the vacuum wiper 172*c*.

In the present embodiment, it is possible to carry out a first wiping process in which the blade wiper unit 171 performs wiping operation and the vacuum wiper unit 172 does not perform wiping operation and a second wiping process in which both the wiper units sequentially perform wiping operation. In the case of the first wiping process, the print controller 202 first draws the wiping unit 17 from the maintenance unit 16 while the print head 8 is evacuated vertically above the maintenance position shown in FIG. 7. The print controller 202 moves the print head 8 vertically downward to a position where the print head 8 can be in contact with the blade wipers 171*a* and then moves the wiping unit 17 into the maintenance unit 16. This movement enables the blade wipers 171*a* to wipe ink and the like adhering to the ejection opening surface 8*a*. That is, the blade wipers 171*a* wipe the ejection opening surface 8*a* when moving from a position drawn from the maintenance unit 16 into the maintenance unit 16.

After the blade wiper unit 171 is housed, the print controller 202 moves the cap unit 10 vertically upward and brings the cap member 10*a* into intimate contact with the ejection opening surface 8*a* of the print head 8. In this state, the print controller 202 drives the print head 8 to perform preliminary ejection and allows the suction pump to suck ink collected in the cap member 10*a*.

In the case of the second wiping process, the print controller 202 first slides the wiping unit 17 to draw it from the maintenance unit 16 while the print head 8 is evacuated vertically above the maintenance position shown in FIG. 7. The print controller 202 moves the print head 8 vertically downward to the position where the print head 8 can be in contact with the blade wipers 171*a* and then moves the wiping unit 17 into the maintenance unit 16. This movement enables the blade wipers 171*a* to perform wiping operation for the ejection opening surface 8*a*. Next, the print controller 202 slides the wiping unit 17 to draw it from the maintenance unit 16 to a predetermined position while the print head 8 is evacuated again vertically above the maintenance position shown in FIG. 7. Then, the print controller 202 uses the flat plate 172*a* and the dowel pins 172*d* to align the ejection opening surface 8*a* with the vacuum wiper unit 172 while moving the print head 8 down to a wiping position shown in FIG. 7. After that, the print controller 202 allows the vacuum wiper unit 172 to perform the wiping operation described above. After evacuating the print head 8 vertically upward and housing the wiping unit 17, the print controller 202 allows the cap unit 10 to perform preliminary ejection into the cap member and suction operation of collected ink in the same manner as the first wiping process.

Next, description will be given of a detailed configuration of the blade wiper unit 171 and the details of wiping operation using the blade wiper unit 171 according to the present embodiment.

Figure 9:
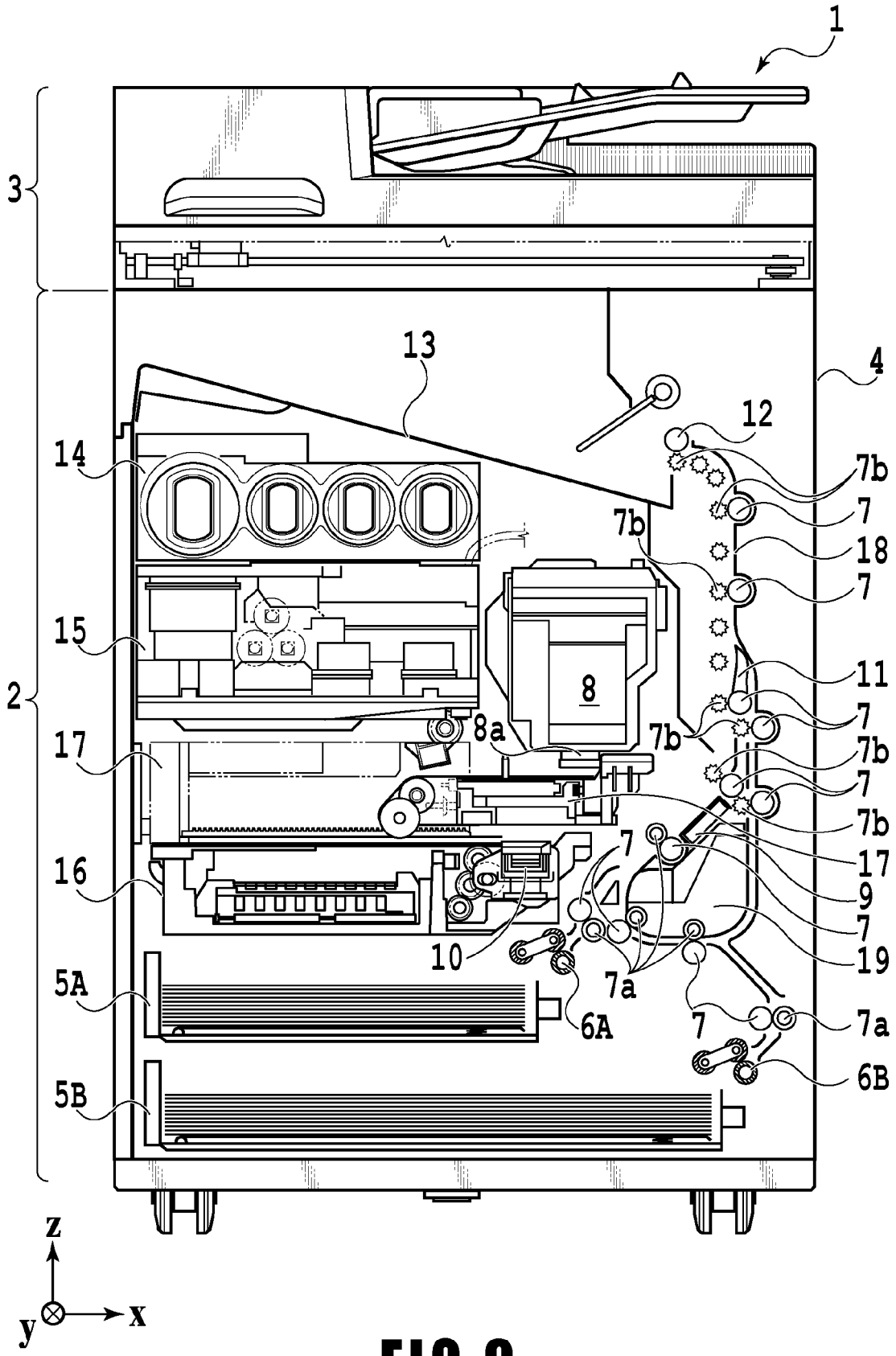
FIG. 9 is a diagram showing wiping operation performed by using a blade wiper unit.

FIG. 9 is a diagram showing wiping operation performed by the printing apparatus 1 using the blade wiper unit 171. FIG. 7 as described above is a diagram showing the wiping operation using the vacuum wiper unit 172. In FIG. 9, the print head 8 is located vertically upward as compared to FIG. 7 and the wiping unit 17 has slightly changed its position closer to an evacuation position as compared to FIG. 7. Upon receiving an instruction to perform wiping operation using the blade wiper unit 171, the print controller 202 controls the print head 8 and the wiping unit 17 to move to the positions shown in FIG. 9.

Description will be given of operation of moving the print head 8 from the standby position shown in FIG. 1 to a maintenance position shown in FIG. 9. The print controller 202 first controls the print head 8 to move in the vertically upward direction relative to the maintenance position shown in FIG. 9. The print controller 202 moves the cap unit 10 down and draws the wiping unit 17 from the maintenance unit 16 to the position shown in FIG. 9. Then, the print controller 202 moves the print head 8 down to the position shown in FIG. 9. After that, the print controller 202 moves the wiping unit 17 to be housed in the maintenance unit 16. Blade wiping is performed through this operation.

The blade wiping is executed in a case where print operation is performed on a predetermined number of print media S, for example, or based on an instruction from a user. The wiping unit 17 moves from the evacuation position shown in FIG. 1 to the position shown in FIG. 9 or moves from the position shown in FIG. 9 to the evacuation position shown in FIG. 1 by a drive mechanism (a moving unit), such as a motor (not shown), driven in accordance with the control by the print controller 202. In other words, the wiping unit 17 is driven in a lateral direction (a second direction) of the print head 8 in the maintenance position by the drive mechanism (not shown).

In this manner, the ejection opening surface of the print head 8 is wiped by the blade wiper unit 171 in the position (a first position) shown in FIG. 9, and the print operation is performed on the print medium S in the position shown in FIG. 3 (a second position which is inclined a predetermined angle in a horizontal direction with respect to the first position). The lateral direction of the print head 8 in the second position is a conveying direction of the print medium S.

Figure 10:
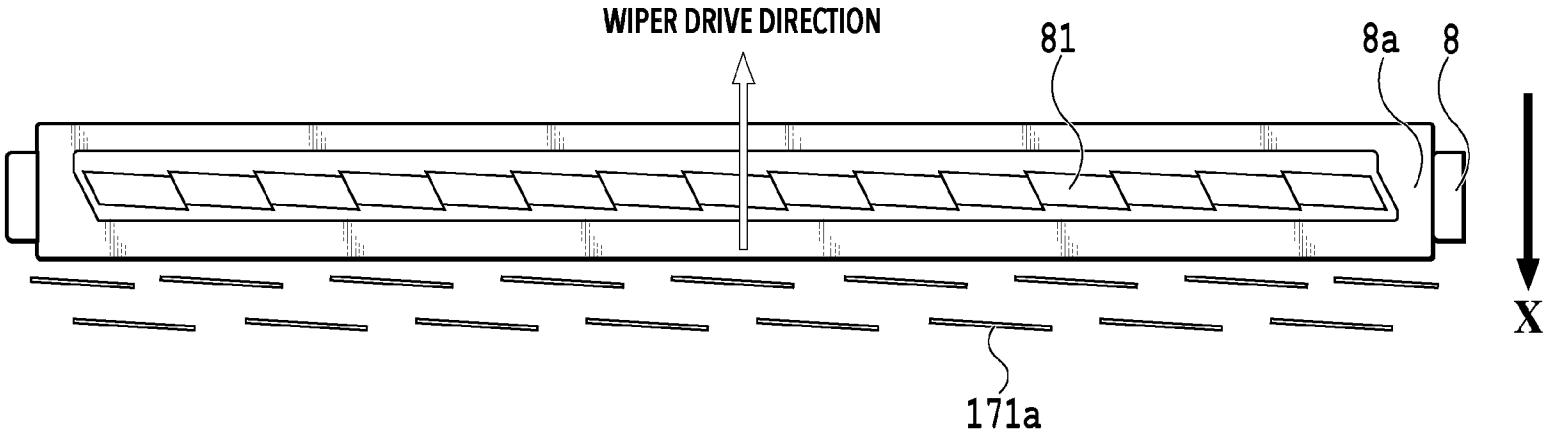
FIG. 10 is a diagram showing an ejection opening surface of a print head and a plurality of blade wipers.

FIG. 10 is a diagram showing the ejection opening surface 8*a* of the print head 8 and the plurality of blade wipers 171*a* that wipe the ejection opening surface 8*a* in the positional relation shown in FIG. 9. FIG. 10 shows a state where the print head 8 and the blade wiper unit 171 are viewed from the bottom. It should be noted that for convenience in understanding, only the blade wipers 171*a* are illustrated as to the blade wiper unit 171, and the illustration of the other members is omitted. The drive mechanism (not shown) drives (moves) the blade wiper unit 171 upward (i.e., a wiper drive direction, or a wiper moving direction) in FIG. 10, thereby performing cleaning operation. That is, ink, paper dust, and the like on the ejection opening surface 8*a* of the print head 8 are wiped off by the blade wipers 171*a*.

As shown in FIG. 10, in the present embodiment, the blade wiper unit 171 has the plurality of blade wipers (wiping members) 171*a*. The blade wipers 171*a* are aligned in a longitudinal direction (a first direction) of the print head 8 to form two staggered rows in the wiper drive direction (in the wiper moving direction). On the ejection opening surface 8*a* of the print head 8, a plurality of ejection units 81 each having a plurality of ejection openings for ejecting ink are arrayed in the first direction. In the present embodiment, the ejection unit 81 is a semiconductor chip having ejection openings formed thereon. Each of the blade wipers 171*a* is provided in a position corresponding to each of the ejection units 81 in the wiper drive direction (the second direction). The wiper drive direction (the second direction) is a direction crossing the longitudinal direction (the first direction) of the print head 8. Furthermore, some of the blade wipers 171*a* are located in the positions where they wipe the ejection opening surface 8*a* around an edge of the print head 8 in the longitudinal direction.

Figure 11:
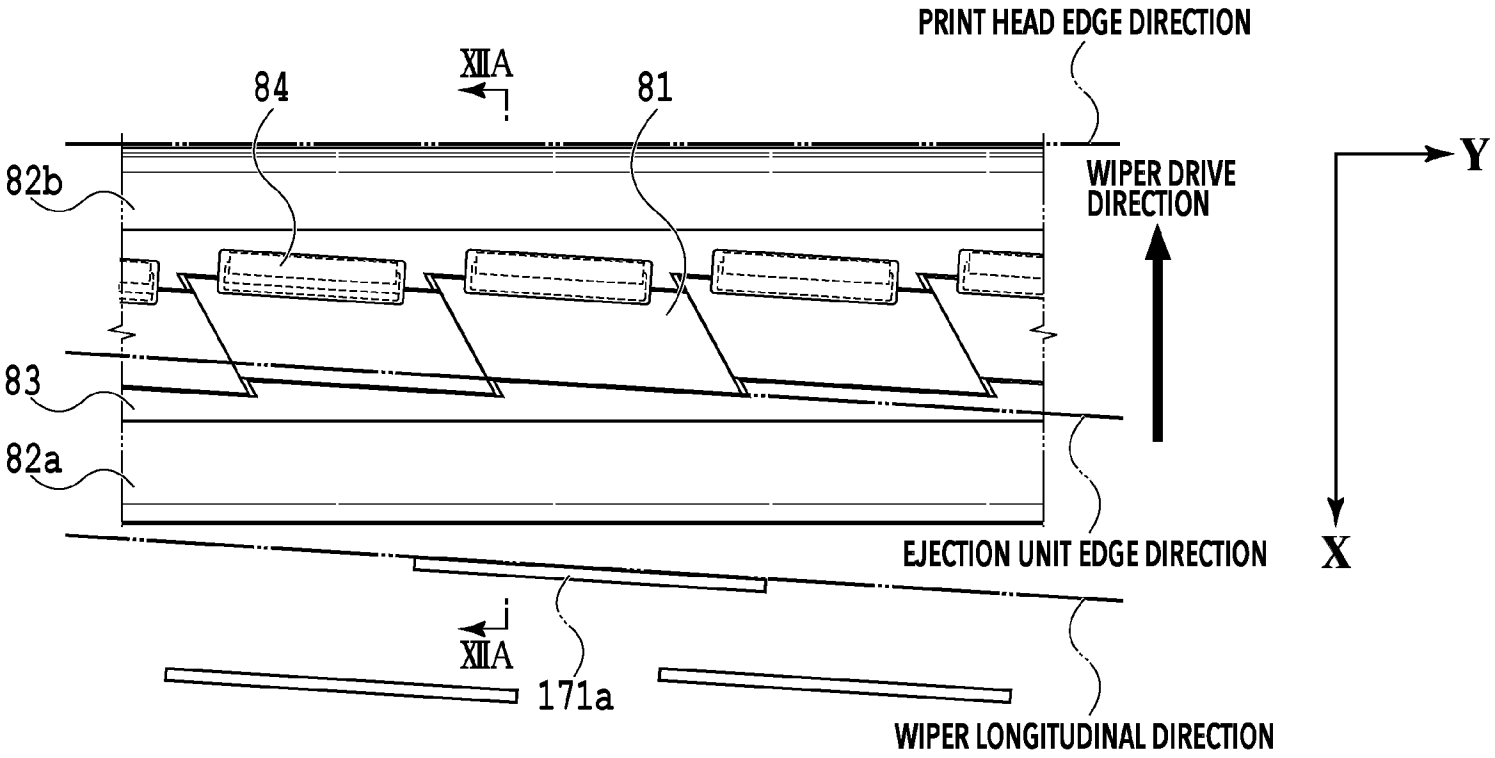
FIG. 11 is a partial enlarged view of FIG. 10.

FIG. 11 is a partial enlarged view of FIG. 10. The ejection opening surface 8*a* of the print head 8 has an ejection unit 81, frame portions 82*a*, 82*b*, a sealing portion 83, and a wiring sealing portion 84. The frame portion 82*a* is located upstream in the wiper drive direction (the second direction) and the frame portion 82*b* is located downstream in the wiper drive direction (the second direction). That is, the frame portion 82*a* is located on a side where the blade wipers 171*a* begin contact with the ejection opening surface 8*a*. The frame portion 82*b* is located on a side where the blade wipers 171*a* end contact with the ejection opening surface 8*a*.

As shown in FIG. 11, in the present embodiment, the longitudinal direction of the blade wipers 171*a* is inclined with respective to an edge (the frame portion 82*b*) of the print head 8 located downstream in the wiper drive direction. The longitudinal direction of the blade wipers 171*a* refers to a width direction in which the blade wipers 171*a* wipe ink off. In this manner, the configuration that the longitudinal direction of the blade wipers 171*a* is inclined with respect to the edge (the frame portion 82*b*) of the print head 8 located downstream in the wiper drive direction can prevent ink or the like having been wiped off by the wiping operation from splattering. Hereinafter, description will be given with reference to FIG. 12. It should be noted that the wiping unit 17 is driven in the wiper drive direction in the printing apparatus 1 of the present embodiment, but for the sake of simplicity, description will be given on the assumption that the blade wiper 171*a* is driven.

Figure 12:
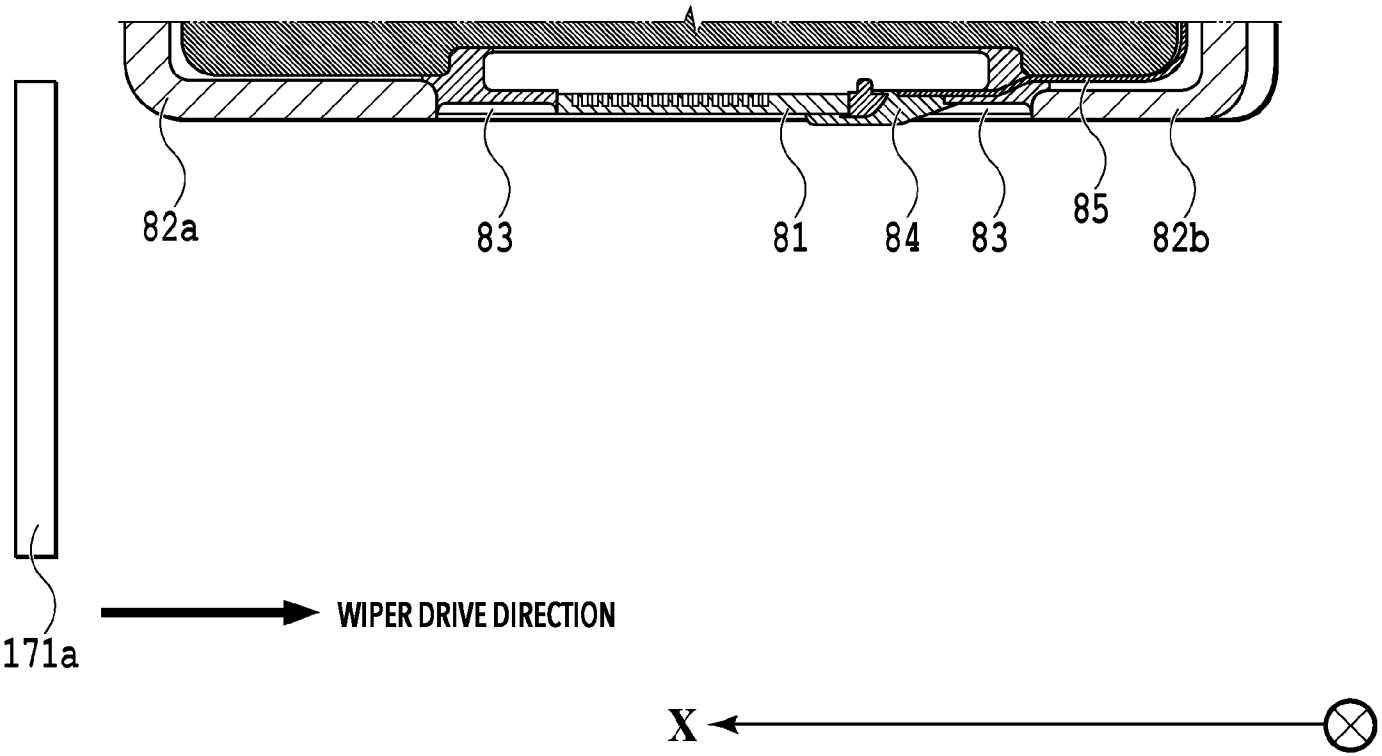
FIG. 12 is a diagram showing a cross section taken along line XIIA-XIIA of FIG. 11.

FIG. 12 is a diagram showing a cross section taken along line XIIA-XIIA of FIG. 11. Wiping is performed by driving the blade wiper 171*a* in the wiper drive direction. First, the blade wiper 171*a* comes into contact with the frame portion 82*a* located upstream in the wiper drive direction. The blade wiper 171*a* is made of an elastic member such as rubber. The upper part of the blade wiper 171*a* comes into contact with the frame portion 82*a* of the print head 8, whereby the blade wiper 171*a* bends (warps) in a direction opposite to the wiper drive direction. In this state, the blade wiper 171*a* is driven in the wiper drive direction. Through this driving operation, the blade wiper 171*a* wipes the sealing portion 83, the ejection unit 81, and the wiring sealing portion 84, and wipes ink and the like off on the sealing portion 83. Then, in the case of passing by the frame portion 82*b* of the print head 8 located downstream in the wiper drive direction, the bent (warped) blade wiper 171*a* returns to its original state. Here, in a case where the longitudinal direction (y-direction in FIG. 11) of the frame portion 82*b* of the print head 8 located downstream in the wiper drive direction is in parallel with the longitudinal direction of the blade wipers 171*a*, the bent (warped) blade wiper 171*a* instantly returns to its original state. This causes the ink or the like having adhered to the blade wiper 171*a* to spatter.

The longitudinal direction of the blade wiper 171*a* according to the present embodiment is inclined with respect to the edge (the frame portion 82*b*) of the print head 8 located downstream in the wiper drive direction. Therefore, in the case of passing by the frame portion 82*b* of the print head 8 located downstream in the wiper drive direction, the blade wiper 171*a* gradually passes by the frame portion 82*b* from its edge. This can prevent the bent (warped) blade wiper 171*a* from instantly returning to its original state. Thus, it is possible to prevent the ink from spattering. The inclination of the longitudinal direction of the blade wiper 171*a* with respect to the frame portion 82*b* of the print head 8 may be an inclination that can prevent ink from spattering. Furthermore, the longitudinal direction of the blade wiper 171*a* is not in parallel with the frame portion 82*b* of the print head 8.

Next, referring back to FIG. 11, description of the blade wiper 171*a* will be continued. The ejection unit 81 is made of a semiconductor chip, for example. If the blade wiper 171*a* comes into contact with a corner portion of the ejection unit 81, force is exerted intensively on the contact point, which easily causes scratches on the blade wiper 171*a*. Therefore, the longitudinal direction of the blade wiper 171*a* according to the present embodiment is substantially in parallel with the direction defined by the edge of the ejection unit 81. According to this configuration, since the blade wiper 171*a* does not come into contact with the one corner portion of the ejection unit 81 and reaction force is not exerted intensively on the one corner portion, it is possible to reduce scratches generated on the blade wiper 171*a*.

As used herein, "substantially in parallel" is intended to mean in parallel even if there is an error due to manufacturing errors or the like. Further, the blade wiper 171*a* may be configured such that the blade wiper 171*a* does not come into contact with the one corner portion of the ejection unit 81 (chip) and reaction force is not exerted intensively on the one corner portion.

Incidentally, the longitudinal direction of the blade wiper 171*a* may be configured to be substantially in parallel with the direction defined by an edge (i.e., an edge located upstream in the wiper drive direction) on the side where the blade wiper 171*a* begins contact with the ejection unit 81. In other words, the longitudinal direction of the blade wiper 171*a* does not need to be substantially in parallel with the direction defined by an edge (i.e., an edge located downstream in the wiper drive direction) on the side where the blade wiper 171*a* ends contact with the ejection unit 81. This is because reaction force is not intensively exerted on the edge (corner) on the side where the blade wiper 171*a* ends contact with the ejection unit 81. That is, as viewed from the ejection unit 81, the ejection unit 81 has a side substantially in parallel with the longitudinal direction of the blade wiper 171*a* on the side (the upstream side in the wiper drive direction) where the blade wiper 171*a* begins to wipe.

Figure 13:
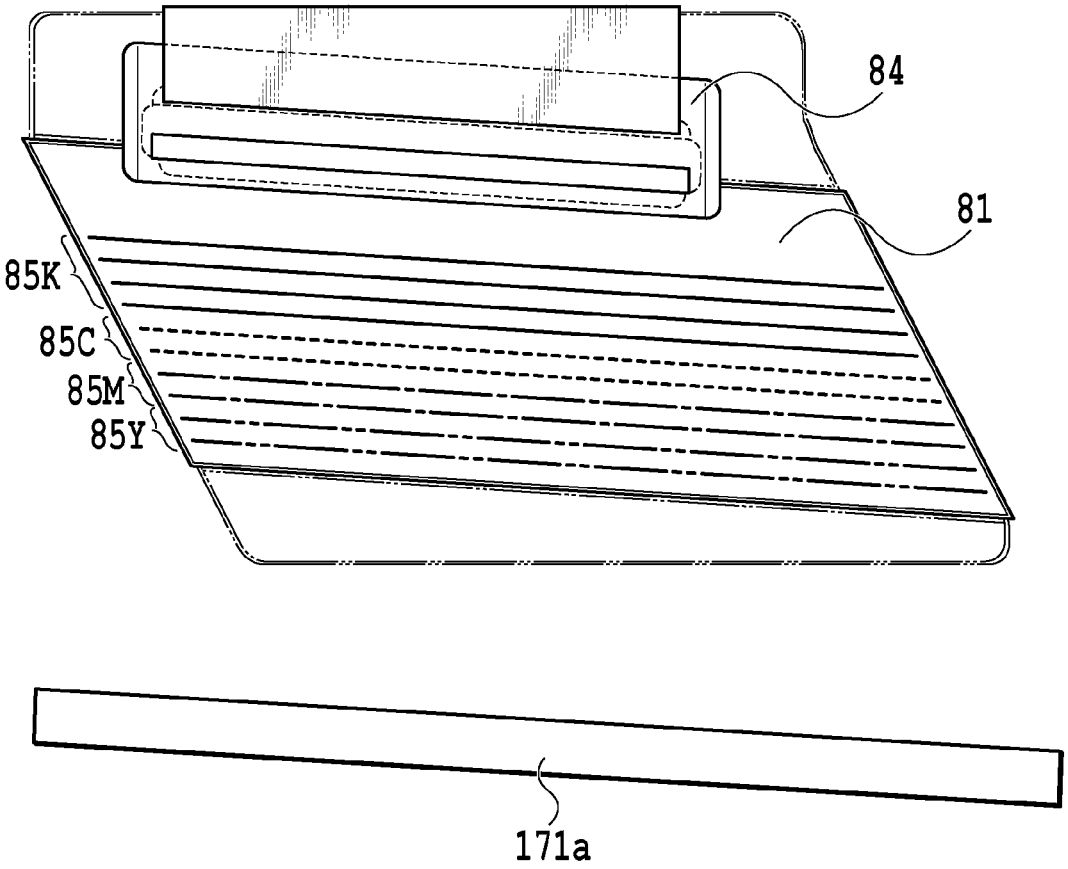
FIG. 13 is an enlarged view of an ejection unit.

FIG. 13 is an enlarged view of the ejection unit 81. The ejection unit 81 is provided with a plurality of ejection openings for ejecting ink. More specifically, on the ejection unit 81, ejection opening arrays 85K, 85C, 85M, 85Y are arranged corresponding to colors of black, cyan, magenta, and yellow, respectively. As shown in FIG. 13, the ejection opening arrays 85K, 85C, 85M, 85Y are aligned and provided substantially in parallel with the longitudinal direction of the blade wiper 171*a*. Furthermore, each ejection unit 81 is connected to wiring and has a wiring sealing portion 84 that seals the wiring. As shown in FIG. 13, also the longitudinal direction of the wiring sealing portion 84 is substantially in parallel with the longitudinal direction of the blade wiper 171*a*. According to this configuration, ink, paper dust, and the like accumulated between the ejection unit 81 and the wiring sealing portion 84 can be easily wiped off.

Figure 14:
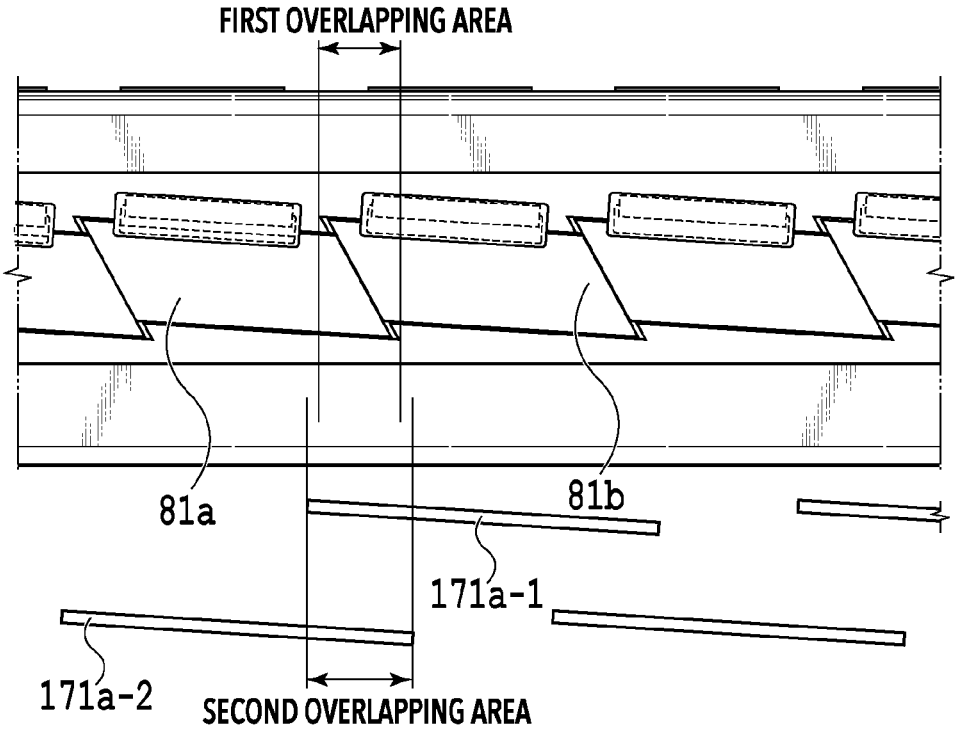
FIG. 14 is a diagram illustrating overlapping areas.

Next, description will be given of overlapping areas. FIG. 14 is a diagram illustrating the overlapping areas. In the present embodiment, there are a first overlapping area and a second overlapping area. As viewed in the lateral direction (the second direction) of the print head 8 at a predetermined position in the longitudinal direction (the first direction) of the print head 8, the first overlapping area refers to an area where the plurality of ejection units 81 exist in the lateral direction of the print head 8. In other words, the ejection units 81 are arranged to have the first overlapping area where adjacent ejection units (ejection units 81*a* and 81*b*) overlap each other in the lateral direction of the print head 8 in a predetermined position in the longitudinal direction of the print head 8. Simply arranging the plurality of ejection units 81 may produce an area where a boundary portion between the ejection units 81 has no ejection opening. Therefore, the first overlapping area is provided so that ejection is performed by either one of the adjacent ejection units 81*a*, 81*b* in the boundary portion between the ejection units 81.

The first overlapping area is an area including the distinct ejection units 81*a*, 81*b* in the lateral direction of the print head 8. This may cause a step to be formed between the ejection unit 81*a* and the ejection unit 81*b*, where it is difficult for the blade wipers 171*a* to wipe compared to the other areas. Accordingly, in the present embodiment, as shown in FIG. 14, the blade wipers 171*a* are configured to have a second overlapping area where adjacent blade wipers 171*a*-1, 171*a*-2 overlap each other. That is, as viewed in the wiper drive direction in a predetermined position in a direction crossing the wiper drive direction, the blade wipers 171*a* are arranged to have the second overlapping area where the adjacent wiping members overlap each other in the wiper drive direction. The second overlapping area is configured to include the first overlapping area therein.

In other words, the print head 8 has a first area (the first overlapping area) where both of the adjacent ejection units 81 are capable of printing in the longitudinal direction (the first direction) of the print head 8. Further, the blade wipers 171*a* have a second area (the second overlapping area) where both of the adjacent blade wipers 171*a* are capable of wiping in the direction (the first direction) crossing the wiper drive direction. The second area is configured to include the first area therein.

According to this configuration, the plurality of blade wipers 171*a* wipe an area where the distinct ejection units 81*a*, 81*b* exist in the lateral direction of the print head 8. This allows reduction of unwiped ink or the like. In the present embodiment, there are a plurality of first overlapping areas and a plurality of second overlapping areas. One of the plurality of first overlapping areas is configured to be included in one of the plurality of second overlapping areas.

Note that in the present embodiment, description has been given of the example of the configuration that the blade wipers 171*a* are arranged to form two rows in the wiper drive direction. However, the present invention is not limited to this. The blade wipers 171*a* may be arranged to form three rows in the wiper drive direction.

Figures 15A, 15B, 15C:
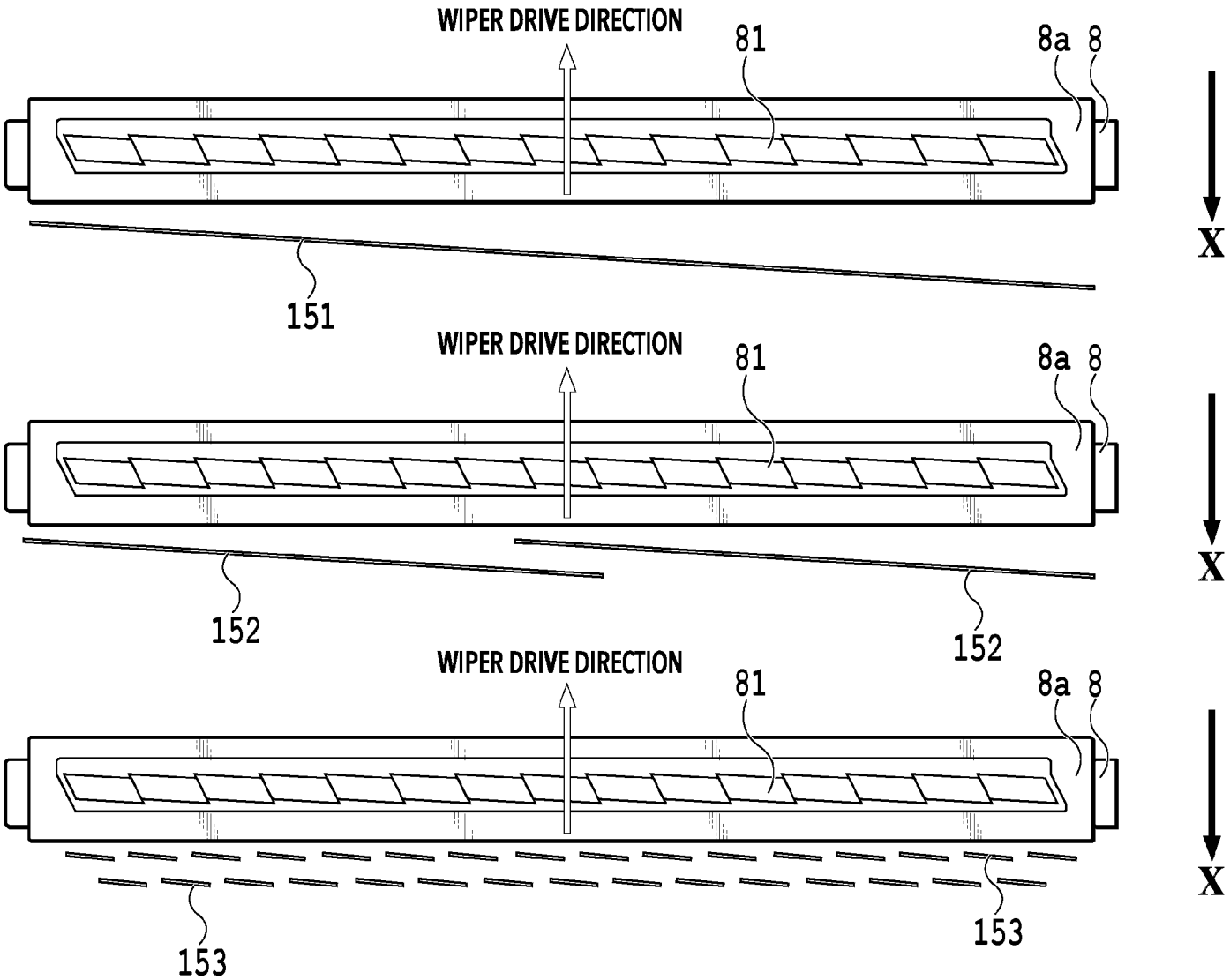
FIGS. 15A to 15C are diagrams showing examples of the other configurations of the blade wipers.

FIGS. 15A to 15C are diagrams showing examples of the other configurations of the blade wipers. FIG. 15A is a diagram showing an aspect that one blade wiper 151 is provided for the print head 8. FIG. 15B is a diagram showing an aspect that one blade wiper 152 is provided for a plurality of ejection units 81. FIG. 15C is a diagram showing an aspect that a plurality of blade wipers 153 are provided for one ejection unit 81. In any of these configurations, the same effect as the one described in the above embodiment can be obtained.

Other Embodiments

In the above-described embodiment, description has been given of the example of the print head 8 having the edge located downstream in the wiper drive direction and the edge located upstream in the wiper drive direction that are in parallel with each other, but the present invention is not limited to this. A print head may be employed in which the edge located downstream in the wiper drive direction is inclined with respect to the edge located upstream in the wiper drive direction. Furthermore, a configuration may be employed that the longitudinal direction of the blade wiper 171*a* is in parallel with the edge of the print head located upstream in the wiper drive direction.

Furthermore, in the above-described embodiment, as described with reference to FIG. 9, the wiping unit 17 is slid and drawn from the maintenance unit 16 in a state where the print head 8 is evacuated in the vertically upward direction. Description has been given of the aspect that after the print head 8 is moved vertically downward, the wiping unit 17 is moved into the maintenance unit 16, whereby wiping is performed. According to this aspect, even if ink spatters, it is possible to prevent the ink from spattering on the conveying path side. However, the present invention is not limited to this example. Wiping may also be performed such that after moving the print head 8 to the position where it can come into contact with the blade wiper 171*a*, the wiping unit 17 is slid and drawn from the maintenance unit 16. That is, wiping may be performed in the case of drawing the wiping unit 17. As described before, according to the above-described embodiment, since spattering of the ink can be prevented, it is possible to suppress spattering of the ink on the conveying path side.

Furthermore, description has been given of the aspect that in the printing apparatus 1 according to the above-described embodiment, the wiping unit 17 provided with the blade wipers 171*a* is driven to the left (that is, in the wiper drive direction) of FIG. 9, whereby the wiping operation is performed. However, the present invention is not limited to this. The print head may be driven in the wiper drive direction (or an opposite direction thereof) by a drive mechanism (not shown), whereby the wiping operation is performed. Alternatively, both of the wiping unit and the print head may be driven. That is, cleaning using a wiping member may be controlled by controlling a relative position between the wiping member and the print head in the lateral direction of the print head.

Furthermore, in the above-described embodiment, description has been given of the aspect that the wiping unit 17 provided with the blade wipers 171*a* is driven in the wiper drive direction. However, the present invention is not limited to this. The blade wipers 171*a* may be driven individually. That is, the wiping members being driven refer to an aspect that individual wiping members are driven separately or an aspect that the wiping unit provided with separate wiping members is driven.

Furthermore, in the above-described embodiment, description has been given of the example of the aspect that a plurality of ejection units are provided in the longitudinal direction of the print head. However, the present invention is not limited to this example. It is also assumed that a print head with a head width that is not that long is used such as a label printer. In such a case, it is possible to employ a configuration that the longitudinal direction and the lateral direction of the print head as described above are reversed.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2017-091337, filed May 1, 2017, which is hereby incorporated by reference wherein in its entirety.

What is claimed is:

1. An inkjet printing apparatus comprising:

a print head having an ejection opening surface on which a plurality of ejection units, each provided with an ejection opening for ejecting ink, are arrayed in a first direction;

a wiping unit configured to wipe the ejection opening surface by moving toward a second direction crossing the first direction, the wiping unit having a plurality of wiping members which are arrayed in the first direction; and a moving unit configured to move the wiping unit in the second direction, wherein a longitudinal direction of each of the wiping members is inclined with respect to a downstream edge of the ejection opening surface and is substantially in parallel with an upstream edge of at least one of the ejection units, wherein the ejection units of the plurality of the ejection units are arrayed to have a first overlapping area where, as viewed in the second direction, edges of adjacent ejection units overlap each other, and wherein the wiping members of the plurality of wiping members are arrayed to have a second overlapping area where, as viewed in the second direction, edges of adjacent wiping members overlap each other, the second overlapping area including the first overlapping area therein.

2. The inkjet printing apparatus according to claim 1, wherein the print head has a first area in the first direction where both of the adjacent ejection units are capable of printing, the wiping members have a second area in the first direction where both of the adjacent wiping members are capable of wiping, and the second area includes the first area therein.

3. The inkjet printing apparatus according to claim 1, wherein one of the plurality of wiping members is provided for at least two ejection units of the plurality of ejection units.

4. The inkjet printing apparatus according to claim 1, wherein at least two wiping members of the plurality of wiping members are provided for one of the plurality of ejection units.

5. The inkjet printing apparatus according to claim 1, wherein the upstream edge of each of the ejection units is a side where at least one wiping member of the plurality of wiping members begins to wipe.

6. The inkjet printing apparatus according to claim 1, wherein each of the ejection units is made of a semiconductor chip.

7. The inkjet printing apparatus according to claim 1, wherein a wiring sealing portion for sealing wiring is further provided on each of the ejection units, and a longitudinal direction of the wiring sealing portion is substantially parallel with the longitudinal direction of the corresponding wiping member.

8. The inkjet printing apparatus according to claim 1, wherein the ejection opening surface of the print head is wiped by the wiping unit with the print head in a first position and the print head is configured to perform a print operation on a print medium in a second position which is inclined a predetermined angle in a horizontal direction with respect to the first position, and the second direction in the second position is a conveying direction of the print medium.

9. An inkjet printing apparatus comprising:

a print head having an ejection opening surface on which a plurality of ejection units, each provided with an ejection opening for ejecting ink, are arrayed in a first direction;

a wiping unit configured to wipe the ejection opening surface by moving toward a second direction crossing the first direction, the wiping unit having a plurality of wiping members which are arrayed in the first direction; and a control unit configured to control a relative position between the wiping unit and the print head in the second direction so as to cause the wiping unit to wipe the ejection opening surface, wherein a longitudinal direction of of each of the wiping members is inclined with respect to a downstream edge of the ejection opening surface and is substantially in parallel with an upstream edge of at least one of the ejection units, wherein the ejection units of the plurality of the ejection units are arrayed to have a first overlapping area where, as viewed in the second direction, edges of adjacent ejection units overlap each other, and wherein the wiping members of the plurality of wiping members are arrayed to have a second overlapping area where, as viewed in the second direction, edges of adjacent wiping members overlap each other, the second overlapping area including the first overlapping area therein.

10. The inkjet printing apparatus according to claim 1, wherein, in case of passing by the ejection opening surface by moving toward the second direction, each wiping member passes by the downstream edge of the ejection opening surface gradually from one edge in the longitudinal direction of the wiping member toward the other edge.

11. The inkjet printing apparatus according to claim 1, wherein, in case of passing by the ejection opening surface by moving toward the second direction, each wiping member, after coming into contact with the upstream edge of at least one of the ejection units, passes by the downstream edge of the ejection opening surface gradually from one edge in the longitudinal direction of the wiping member toward the other edge.

* * * * *